US007871282B2

(12) United States Patent
Gosis et al.

(10) Patent No.: US 7,871,282 B2
(45) Date of Patent: Jan. 18, 2011

(54) AIRCRAFT POWER CONNECTOR WITH DIFFERENTIAL ENGAGEMENT AND OPERATIONAL RETENTION FORCES

(75) Inventors: Anatoly Gosis, Palatine, IL (US); Scott Takayuki Koizumi, Fairfield, CA (US); Folkert Fred Koch, San Ramon, CA (US); Frank Otte, Mt. Prospect, IL (US); Dennis Bednarz, Des Plaines, IL (US)

(73) Assignee: Illinois Tool Works Inc., Glenview, IL (US)

( * ) Notice: Subject to any disclaimer, the term of this patent is extended or adjusted under 35 U.S.C. 154(b) by 950 days.

(21) Appl. No.: 11/681,674

(22) Filed: Mar. 2, 2007

(65) Prior Publication Data

US 2010/0029123 A1 Feb. 4, 2010

Related U.S. Application Data

(60) Provisional application No. 60/781,842, filed on Mar. 13, 2006.

(51) Int. Cl.
*H01R 13/15* (2006.01)

(52) U.S. Cl. ..... 439/265

(58) Field of Classification Search ..... 439/259, 439/261, 265
See application file for complete search history.

(56) References Cited

U.S. PATENT DOCUMENTS 1,119,864 A * 12/1914 Ovington ..... 439/269.2
3,643,202 A * 2/1972 Coon ..... 439/263

* cited by examiner

*Primary Examiner*—Phuong K Dinh
(74) *Attorney, Agent, or Firm*—Fletcher Yoder

(57) ABSTRACT

A new and improved aircraft power connector, for electrical connection to an aircraft electrical connector, has incorporated thereon a dual-position mechanism which can effectively alter the engagement force level defined between the electrical connector contact pins of the aircraft power connector and the aircraft electrical connector. When the mechanism is disposed at a first position, the force level is relatively low so as to easily permit connection and disconnection, whereas when the mechanism is disposed at a second position, the force level is relatively high so as to ensure the connection of the aircraft power connector to the aircraft electrical connector and thereby prevent the inadvertent disconnection of the aircraft power connector from the aircraft electrical connector.

24 Claims, 6 Drawing Sheets

AIRCRAFT POWER CONNECTOR WITH DIFFERENTIAL ENGAGEMENT AND OPERATIONAL RETENTION FORCES

CROSS REFERENCE TO RELATED APPLICATION

This application claims priority to U.S. Provisional Application No. 60/781,842, filed on Mar. 13, 2006, which is hereby incorporated by reference.

FIELD OF THE INVENTION

The present invention relates generally to aircraft power connectors, and more particularly to a new and improved aircraft power connector which has a dual-position force level determination mechanism integrally incorporated thereon that effectively provides the new and improved aircraft power connector with differential, relatively low insertion force and relatively high operational retention force levels so as to respectively permit operational personnel to easily mount and mate the new and improved aircraft power connector upon and with the onboard aircraft electrical connector when the new and improved aircraft power connector is to be electrically connected to the onboard aircraft electrical connector, while alternatively ensuring that the electrical connection, once the same has been established between the new and improved aircraft power connector and the onboard aircraft electrical connector, will in fact be assuredly maintained during the time that the new and improved aircraft power connector, and its associated electrical power cable, are electrically connected to the onboard aircraft electrical connector in order to provide electrical power to the aircraft during those time periods that the aircraft is, for example, on the ground and being serviced at the aircraft terminal between flights.

BACKGROUND OF THE INVENTION

When an aircraft, whether it comprises a military aircraft or a commercial airliner, is being serviced, a mobile ground power cart is usually moved toward and located near the aircraft so as to be capable of supplying necessary electrical power by means of a suitable electrical power cable. Normally, of course, electrical power for the aircraft is self-generated on board the aircraft by means of suitable generator apparatus which is adapted to be normally driven by means of the aircraft's engine or engines. In order to provide the aircraft with such externally generated electrical power, the aircraft is of course provided with a suitable electrical connector, and the electrical power cable disposed upon the mobile ground power cart is provided with a suitable aircraft power connector which is adapted to be electrically connected to the onboard aircraft electrical connector. As may well be appreciated, when the aircraft power connector of the mobile ground power cart power cable is to be electrically connected to the aircraft electrical connector disposed upon the aircraft, it is imperative that the retention force, that has been developed or established between, for example, the female receptacle portions of the electrical connector contact pins of the aircraft power connector, and the male electrical connector contact pins disposed upon and projecting outwardly from the onboard aircraft electrical connector, be sufficiently large such that the integrity of the electrical connection, which has been established between the aircraft power connector and the onboard aircraft electrical connector, will not be inadvertently adversely compromised or interrupted throughout the entire time period that the mobile ground power cart is being used to supply electrical power to the aircraft.

However, if the aforenoted retention force, that has been developed or established between the aircraft power connector and the onboard aircraft electrical connector, is sufficiently large such that the integrity of the electrical connection, which has been established between the aircraft power connector and the onboard aircraft electrical connector, will not be inadvertently adversely compromised or interrupted throughout the entire time period that the mobile power cart is being used to supply electrical power to the aircraft, then it is to be additionally appreciated that the insertion force, that is required to initially establish the electrical connection between the aircraft power connector and the onboard aircraft electrical connector, will likewise be sufficiently large. A sufficiently large insertion force, however, sometimes presents procedural problems or difficulties for operational personnel in that the onboard aircraft electrical connector is not always disposed at a location upon the aircraft which is easily or readily accessible to operational personnel. For example, the onboard aircraft electrical connector may be disposed at a location which is relatively inaccessible or at least difficult to access by operational personnel. Alternatively, the onboard aircraft electrical connector may be located at a relatively high elevational position. Alternatively, still further, the onboard aircraft electrical connector may be disposed at a location which requires operational personnel to access it only from a particular direction or angular orientation. Accordingly, under any one of the aforenoted conditions, when operational personnel seek to establish the electrical connection between the aircraft power connector and the onboard aircraft electrical connector, the operational personnel may not always be able to exert the relatively large insertion force which is required to in fact establish the electrical connection between the aircraft power connector and the onboard aircraft electrical connector.

A need therefore exists in the art for a new and improved aircraft power connector which effectively exhibits differential insertion and operational retention forces such that operational personnel are readily able to initially establish an electrical connection between the aircraft power connector and the onboard aircraft electrical connector with a relatively minimal force exertion level, regardless of the particular location or accessibility of the aircraft electrical connector disposed on board the aircraft, and yet once the electrical connection is in fact established between the aircraft power connector and the onboard aircraft electrical connector, the retention force level, between the aircraft power connector and the onboard aircraft electrical connector, can be significantly enhanced or sufficiently high such that the electrical connection, that has been established between the aircraft power connector and the onboard aircraft electrical connector, will be assuredly maintained and not be inadvertently adversely compromised or interrupted. Still yet further, when the electrical connection between the aircraft power connector and the onboard aircraft electrical connector is in fact to be discontinued, such as, for example, when the servicing of the aircraft has been completed, the retention force level, maintaining the aircraft power connector electrically connected to the onboard aircraft power connector, can in fact be intentionally reduced so as to permit the aircraft power connector to in fact be easily and readily disconnected from the onboard aircraft electrical connector.

SUMMARY OF THE INVENTION

The foregoing and other objectives are achieved in accordance with the teachings and principles of the present invention through the provision of a new and improved aircraft power connector which comprises an aircraft power connector housing within which there is provided a plurality of electrical connector pins, such as, for example, six electrical connector pins, wherein the six electrical connector pins are arranged within a standard array of two rows of electrical connector pins, with three electrical connector pins disposed within each row, so as to match the standard array of six male electrical connector pins disposed upon and projecting outwardly from the onboard aircraft electrical connector. The internal bores of the female receptacle end portions of the electrical connector pins, disposed upon the aircraft power connector, are slightly enlarged such that when the female receptacle end portions of the electrical connector pins, disposed upon the aircraft power connector, are to be engaged and mated with the male electrical connector pins, disposed upon and projecting outwardly from the onboard aircraft electrical connector, the electrical connection between the female receptacle end portions of the electrical connector pins, disposed upon the aircraft power connector, and the male electrical connector pins, disposed upon and projecting outwardly from the onboard aircraft electrical connector, can be easily and readily established with a reduced insertion force level.

A slot is formed within the female receptacle end portion of the aircraft power connector housing, which is to be physically and electrically mounted upon and mated with the male electrical connector pins disposed upon and projecting outwardly from the onboard aircraft electrical connector, such that the slot is interposed between the two rows of electrical connector pins disposed upon the aircraft power connector housing, and a transversely extending elongated force-transmission cam plate member is disposed within the slot such that oppositely disposed end portions of the elongated force-transmission cam plate member project outwardly from the aircraft power connector housing so as to be fixedly connected to first oppositely disposed end portions of a pair of substantially L-shaped lever members. An operating handle mechanism is pivotally mounted between second oppositely disposed end portions of the pair of lever members so as to be movable between first and second operative positions, and the operating handle mechanism includes a secondary cam member which is adapted to be correspondingly moved between first and second operative positions. Accordingly, when, for example, the operating handle mechanism and the secondary cam member are disposed at their first operative positions, the cam plate member will be disposed at a first non-camming position so as to permit the female receptacle end portions of the electrical connector pins, disposed upon the aircraft power connector, to be readily and easily engaged with the male electrical connector pins disposed upon and projecting outwardly from the onboard aircraft electrical connector in accordance with the aforenoted reduced insertion force level.

Conversely, when the operating handle mechanism and the secondary cam member are moved so as to be disposed at their second positions, subsequent to the mating of the aircraft power connector with the onboard aircraft electrical connector, the cam plate member will be disposed at a second camming position so as to effectively force one of the rows of female receptacle end portions of the electrical connector pins, disposed upon the aircraft power connector, into enhanced frictional contact with a corresponding row of the male electrical connector pins disposed upon the onboard aircraft electrical connector so as to effectively significantly enhance the retention force level established between the aforenoted row of female receptacle end portions of the electrical connector pins, disposed upon the aircraft power connector, and the corresponding row of male electrical connector pins disposed upon the onboard aircraft electrical connector, thereby effectively preventing inadvertent disconnection of the aircraft power connector from the onboard aircraft electrical connector. Continuing further, when in fact the electrical connection between the aircraft power connector and the onboard aircraft electrical connector is to be discontinued, such as, for example, when the servicing of the aircraft has been completed, the operating handle mechanism and the secondary cam member are returned to their first positions thereby effectively alleviating the enhanced retention force level within the electrical connection defined between the aircraft power connector and the onboard aircraft power connector, and effectively reestablishing the reduced insertion force level within the electrical connection defined between the aircraft power connector and the onboard aircraft power connector, whereby the aircraft power connector can now be easily and readily disconnected and released from the onboard aircraft power connector.

BRIEF DESCRIPTION OF THE DRAWINGS

Various other features and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE ILLUSTRATED EMBODIMENTS

Figure 1:
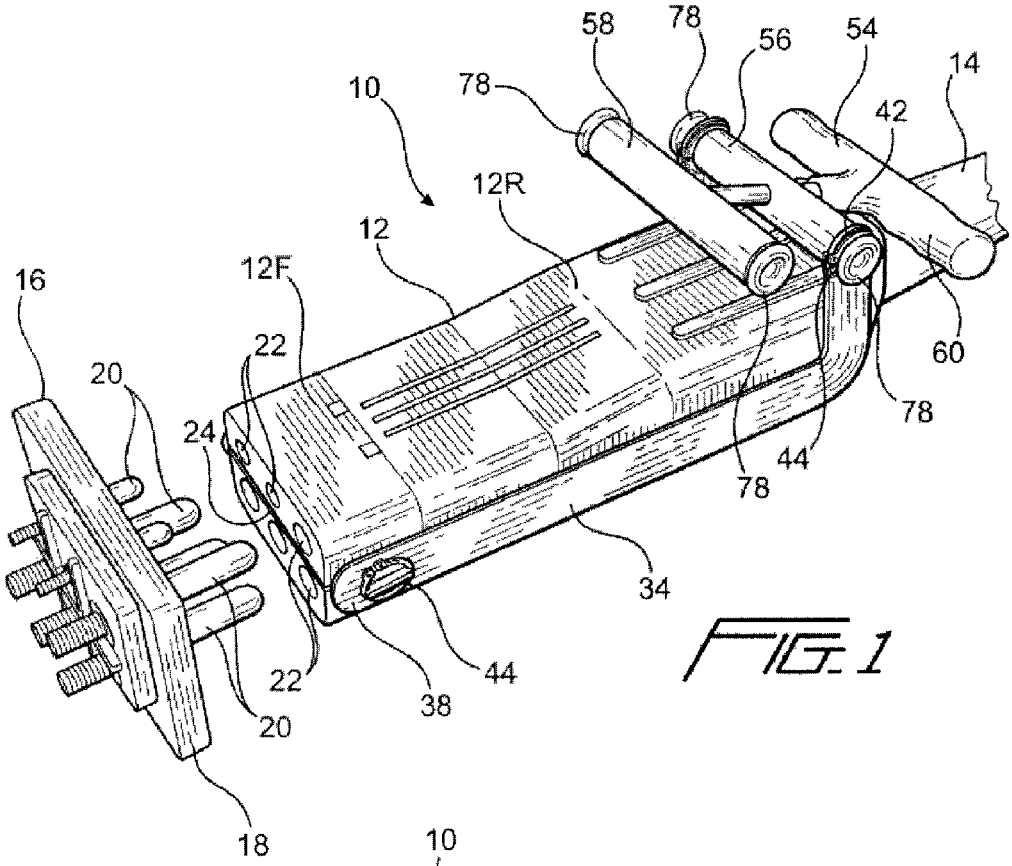
FIG. 1 is a perspective view of the new and improved aircraft power connector which has been constructed in accordance with the principles and teachings of the present invention, wherein the new and improved aircraft power connector is illustrated as being disposed adjacent to a conventional onboard aircraft electrical connector with which it is adapted to establish an electrical connection, and wherein the dual-position connection force level determination mechanism of the new and improved aircraft power connector is illustrated as being disposed in its first RELEASED position whereby the new and improved aircraft power connector will exhibit a relatively low insertion force level.
Figure 2:
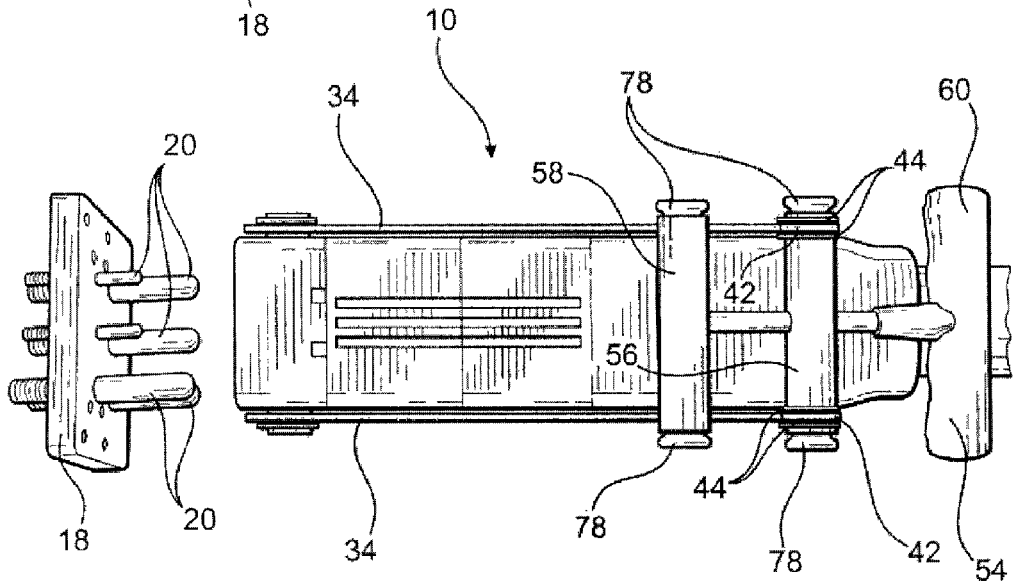
FIG. 2 is a substantially top plan view of the new and improved aircraft power connector, corresponding to the new and improved aircraft power connector as illustrated in FIG. 1 with respect to the conventional onboard aircraft electrical connector.

Referring now to the drawings, and more particularly to FIGS. 1-5 thereof, a new and improved aircraft power connector, constructed in accordance with the principles and teachings of the present invention, is disclosed and is generally indicated by the reference character 10. The new and improved aircraft power connector 10 is seen to comprise an aircraft power connector housing 12, and while the aircraft power connector housing 12 is illustrated as comprising a forward housing section 12F and a rearward housing section 12R which has a power cable 14 physically and electrically connected thereto, the aircraft power connector housing 12 may alternatively be fabricated as a one-piece construction and will effectively be treated as such for the purposes of this disclosure. More particularly, the aircraft power connector 10 is adapted to be physically and electrically connected to a conventional or standard aircraft electrical connector 16, which is fixedly mounted at a predetermined location upon an aircraft, so as to provide electrical power to the aircraft when the aircraft is being serviced. The aircraft electrical connector 16 is seen to comprise a mounting plate structure 18 upon which six male electrical connector pins 20 are fixedly mounted so as to project outwardly therefrom, and it is seen that the six male electrical connector pins 20 are arranged within two rows with each one of the two rows comprising three male electrical connector pins 20. Correspondingly, it is seen that the forward end portion of the aircraft power connector housing 12 is provided with six bores 22 within which six electrical connector pins, not visible in the drawings, are fixedly mounted, and as was the case with the aircraft electrical connector 16, the six bores 22 and six electrical connector pins are arranged within two rows with each one of the two rows comprising three electrical connector pins. The forward end portions of the six electrical connector pins, not visible in the drawings, that are disposed within the aircraft power connector housing 12 comprise female receptacles, and in this manner, the aircraft power connector 10 is able to be physically and electrically mated with the aircraft electrical connector 16.

It is noted that, when a conventional aircraft power connector, similar to the aircraft power connector 10 of the present invention, is to be electrically connected to the aircraft electrical connector 16, the retention force, that is developed or established between, for example, the female receptacle portions of the electrical connector contact pins of the conventional aircraft power connector and the male electrical connector contact pins 20 of the aircraft electrical connector 16, is intentionally designed to be sufficiently large and relatively high, such as, for example, to be within the range of 80 lb±20 lb, such that the integrity of the electrical connection, which has been established between the conventional aircraft power connector and the onboard aircraft electrical connector 16, will not be inadvertently adversely interrupted or otherwise compromised throughout the entire time period that the conventional aircraft power connector and its associated electrical cable, similar to the aircraft power connector 10 and the electrical cable 14, are being used to supply electrical power to the aircraft. This retention force is a function of, for example, the friction or interference fit defined between the external or outside diameter dimensions of the male electrical connector contact pins 20 disposed upon the aircraft electrical connector 16 and the internal or inner diameter dimensions of the female receptacle portions of the electrical connector contact pins disposed within the conventional aircraft power connector.

However, it is additionally noted that, if such retention force, that has been developed or established between the conventional aircraft power connector and the onboard aircraft electrical connector 16, is sufficiently large or relatively high such that the integrity of the electrical connection, which has been established between the conventional aircraft power connector and the onboard aircraft electrical connector 16, will not be inadvertently adversely compromised or interrupted throughout the entire time period that the conventional aircraft power connector and its associated electrical cable, similar to the aircraft power connector 10 and the electrical cable 14, are being used to supply electrical power to the aircraft, then the insertion force, that is required to initially establish the electrical connection between the conventional aircraft power connector and the onboard aircraft electrical connector 16, will likewise be large or relatively high. As has been noted hereinbefore, such a relatively large or high insertion force level will sometimes present procedural problems or difficulties for operational personnel in connection with the establishment of the electrical connection between the conventional aircraft power connector and the onboard aircraft electrical connector 16.

In accordance with one of the principles and teachings of the present invention, the internal or inner diameter dimensions of the female receptacle portions of the electrical connector contact pins disposed within the aircraft power connector housing 12 are enlarged to a predetermined degree, such as, for example, one thousandth of an inch (0.001") with respect to the external or outside diameter dimensions of the male electrical connector contact pins 20 disposed upon the aircraft electrical connector 16. In this manner, the insertion force which is required to initially mate the aircraft power connector 10 with the aircraft electrical connector 16, and which is a function of, for example, the friction or interference fit defined between the internal or inner diameter dimensions of the female receptacle portions of the electrical connector contact pins disposed within the aircraft power connector housing 12 and the external or outside diameter dimensions of the male electrical connector contact pins 20 disposed upon the aircraft electrical connector 16, is able to be substantially reduced to a more manageable level, such as, for example, within the range of 20 lb±5 lb.

While the insertion force level characteristic of the new and improved aircraft power connector 10 of the present invention has effectively been reduced in accordance with the aforenoted structure so as to enable operational personnel to easily and readily achieve the physical and electrical connection between the female receptacle portions of the electrical connector contact pins disposed within the aircraft power connector housing 12 and the male electrical connector contact pins 20 disposed upon the aircraft electrical connector 16, it is of course to be appreciated that such force level, as defined between the female receptacle portions of the electrical connector contact pins disposed within the aircraft power connector housing 12 and the male electrical connector contact pins 20 disposed upon the aircraft electrical connector 16, is not in fact sufficient to assuredly retain the aircraft power connector 10 and the aircraft electrical connector 16 physically and electrically connected to each other. Therefore, additional means must be provided upon the new and improved aircraft power connector 10 of the present invention in order to effectively raise or enhance the force level, defined between the female receptacle portions of the electrical connector contact pins disposed within the aircraft power connector housing 12 and the male electrical connector contact pins 20 disposed upon the aircraft electrical connector 16, such that subsequent to the physical and electrical connection together of the aircraft power connector 10 with the aircraft electrical connector 16, the connection defined between the aircraft power connector 10 and the aircraft electrical connector 16 will assuredly be retained.

Figure 9:
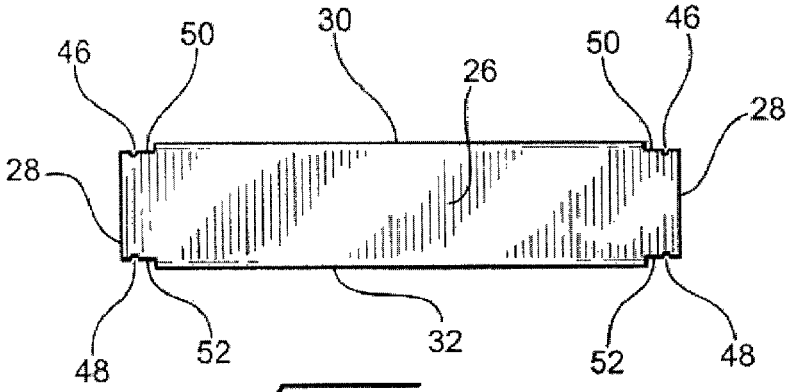
FIG. 9 is a top plan view of the force-transmission cam plate member of the dual-position connection force level determination mechanism of the new and improved aircraft power connector of the present invention.
Figure 10:
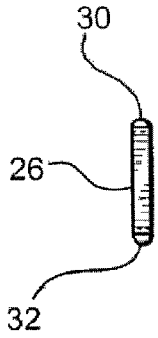
FIG. 10 is an end elevational view of the force-transmission cam plate member as illustrated within FIG. 9.

With reference therefore now being made to FIGS. 1-5, it is initially noted that the aircraft power connector housing 12 is fabricated from a suitable rubber-type material such as, for example, neoprene rubber, polyurethane, or the like, and as can best be seen in FIG. 1, a transversely or laterally extending slot 24 is formed within the forward end portion of the aircraft power connector housing 12 so as to extend rearwardly a predetermined distance from the front face of the aircraft power connector housing 12. The slot 24 is also seen to be formed between the upper and lower rows of electrical connector bores 22 defined within the forward end portion of the aircraft power connector housing 12, and in this manner, the forward end portion of the aircraft power connector housing 12 is effectively divided into upper and lower half portions. A force-transmission cam plate member 26, as can best be seen and appreciated from FIGS. 9 and 10, is adapted to be inserted into the slot 24 such that the oppositely disposed end portions 28 of the force-transmission cam plate member 26 project laterally outwardly from the oppositely side wall portions of the aircraft power connector housing 12, and as can best be appreciated from FIG. 10, it is additionally seen that the longitudinally spaced edge portions 30, 32 of the force-transmission cam plate member 26 have rounded or arcuate configurations so as not to abrade the rubber-type material from which the aircraft power connector housing 12 is fabricated when the force-transmission cam plate member 26 is rotated between its first and second limit positions as will become more fully appreciated hereinafter.

Figure 7:
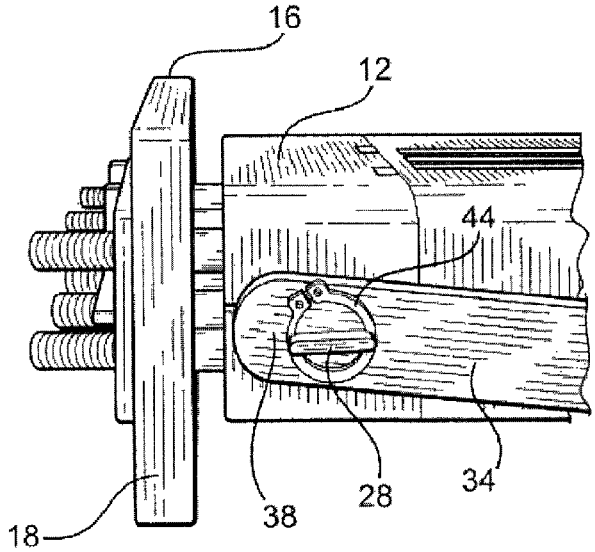
FIG. 7 is an enlarged, partial, substantially side elevational view of the new and improved aircraft power connector, as illustrated within FIG. 3, showing the details of the connection of a first end portion of one of the lever arms, of the dual-position connection force level determination mechanism of the new and improved aircraft power connector, as mounted upon one end of a force-transmission cam plate member, which projects outwardly through a side wall portion of the aircraft power connector housing, by means of a retaining ring or snap-ring member.
Figure 8:
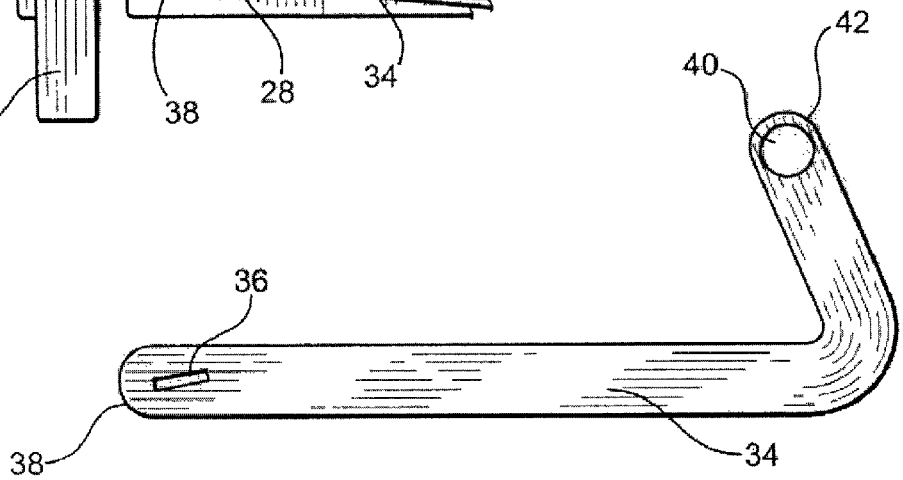
FIG. 8 is a side elevational view of one of the substantially L-shaped lever members of the dual-position connection force level determination mechanism of the new and improved aircraft power connector of the present invention.
Figure 11:
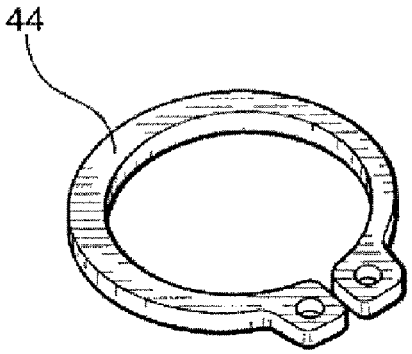
FIG. 11 is a perspective view of a retaining ring or snap-ring member used to secure together component parts of the dual-position connection force level determination mechanism of the new and improved aircraft power connector of the present invention.

In order to actuate or rotatably move the force-transmission cam plate member 26 between its first and second limit positions, a pair of lever members 34, 34, each one of which has a substantially L-shaped configuration, are operatively connected to the oppositely disposed end portions 28, 28 of the force-transmission cam plate member 26. More particularly, as can best be appreciated from FIG. 8, wherein the details of one of the lever members 34 is disclosed, each one of the lever members 34 has a through-slot 36 defined within a first end portion 38 thereof, while a through-bore 40 is defined within a second opposite end portion 42 of each lever member 34. The oppositely disposed end portions 28, 28 of the force-transmission cam plate member 26 are adapted to be respectively inserted through the slots 36, 36 that are respectively defined within the first end portions 38, 38 of the oppositely disposed lever members 34, 34, and in order to secure the first end portions 38, 38 of the oppositely disposed lever members 34, 34 upon the oppositely disposed end portions 28, 28 of the force-transmission cam plate member 26, a pair of retaining rings, snap-rings, or spring-clips 44, 44, as can best be appreciated from FIGS. 7 and 11, are adapted to be mounted upon the oppositely disposed end portions 28, 28 of the force-transmission cam plate member 26. More particularly, as can best be appreciated from FIG. 9, each one of the oppositely disposed end portions 28, 28 of the force-transmission cam plate member 26 has a pair of grooves or recesses 46, 48 respectively defined within the longitudinally spaced edge portions 50, 52 thereof. Accordingly, after the oppositely disposed end portions 28, 28 of the force-transmission cam plate member 26 are respectively inserted through the slots 36, 36 respectively defined within the first end portions 38, 38 of the lever members 34, 34, and when the snap-rings, retaining rings, or spring-clips 44, 44 are respectively snap-fitted over the oppositely disposed end portions 28, 28 of the force-transmission cam plate member 26 such that inner surface portions of the snap-rings, retaining rings, or spring clips 44, 44 are disposed in surface-to-surface contact with outer surface portions of the lever members 34, 34 while diametrically opposite portions of the snap-rings, retaining rings, or spring clips 44, 44 are respectively seated within the grooves or recesses 46, 48 of the oppositely disposed end portions 28, 28 of the force-transmission cam plate member 26, the retaining rings, snap-rings, or spring clips 44, 44 will effectively securely mount the first end portions 38, 38 of the lever members 34, 34 onto the oppositely disposed end portions 28, 28 of the force-transmission cam plate member 26 as can best be appreciated from FIG. 7.

Continuing further, in order to actuate or rotatably move the pair of lever members 34, 34, an actuating handle assembly is operatively associated with the second end portions 42, 42 of the lever members 34, 34. More particularly, the actuating handle assembly comprises a handle 54 having a substantially T-shaped configuration, a rotary member 56 rotatably mounted, around its longitudinal axis, through means of its oppositely disposed end portions being disposed within the through-bores 40, 40 defined within the second opposite end portions 42, 42 of the oppositely disposed lever members 34, 34, and a secondary cam member 58 fixedly mounted upon the distal end of the handle 54. The handle 54 comprises a transversely oriented finger or hand-grasping portion 60, and a shaft portion 62 which is adjustably mounted within the rotary member 56. The shaft portion 62 may be fabricated, for example, from a structural member having a hexagonal cross-sectional configuration, such as, for example, an Allen wrench, and it is additionally to be appreciated that the upper end portion of the shaft member can be bent 90° in a first direction and then bent again, in effect back upon itself 180° in the opposite direction, so as to effectively form an integrally connected transversely oriented structural member that forms the internal cross-member of the hand-grasping portion 60. A suitable thermoplastic material may then be molded over the upper end portion of the shaft member and the cross-member so as to form the hand-grasping portion 60.

Figure 6:
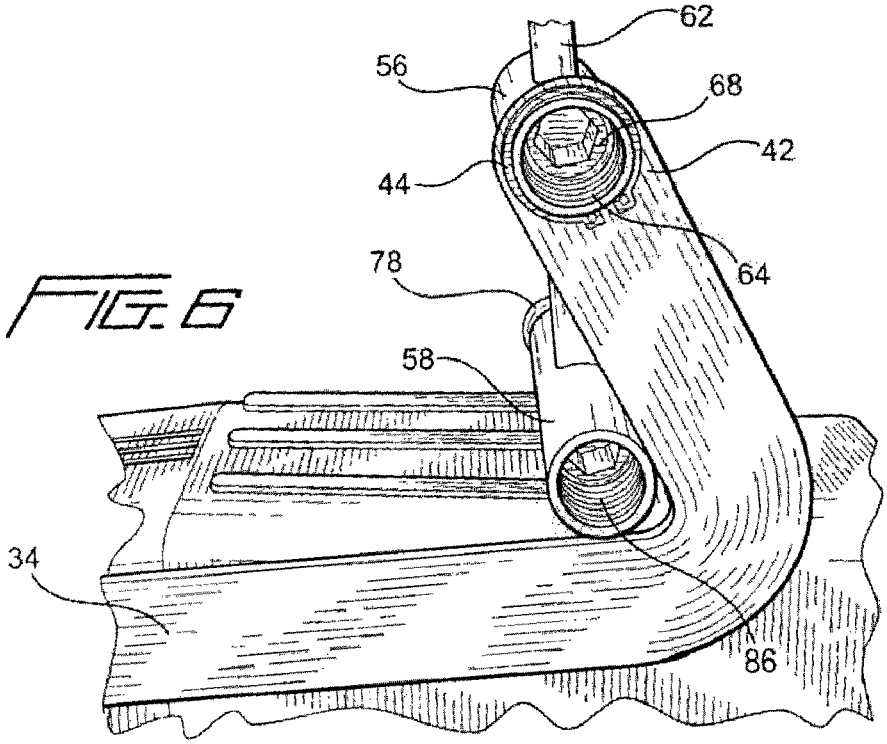
FIG. 6 is an enlarged, partial, substantially side elevational view of the new and improved aircraft power connector, as illustrated within FIG. 5, showing the internal details of the rotary tube and secondary cam members of the dual-position connection force level determination mechanism of the new and improved aircraft power connector.
Figure 16:
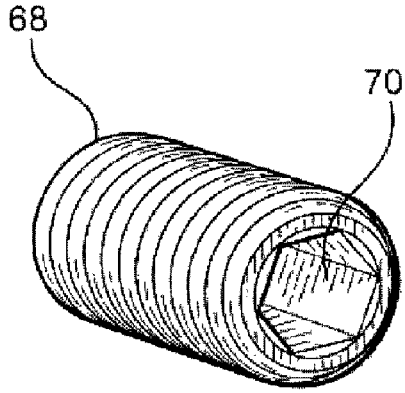
FIG. 16 is rear perspective view of a set screw member which may be used within either one of the rotary tubular member or the secondary cam member as illustrated within FIGS. 12 and 13, or FIGS. 14 and 15, respectively.
Figure 17:
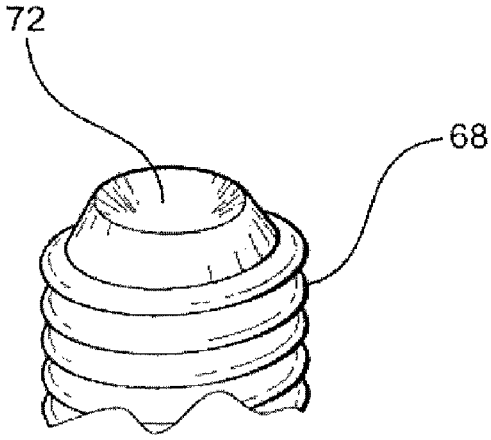
FIG. 17 is a perspective view of the forward end portion of the set screw as disclosed within FIG. 16.
Figure 12:
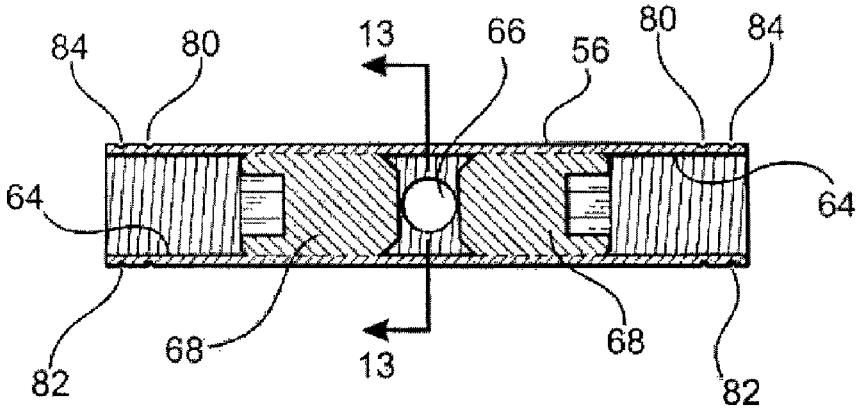
FIG. 12 is a longitudinal cross-sectional view of the rotary tubular member of the dual-position connection force level determination mechanism of the new and improved aircraft power connector of the present invention.
Figure 13:
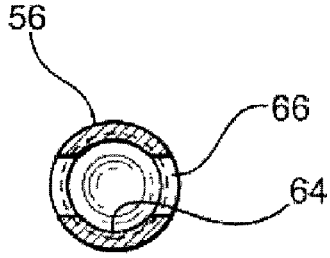
FIG. 13 is a cross-sectional view of the rotary tubular member as disclosed within FIG. 12 as taken along the lines 13-13 of FIG. 12.

With reference being additionally made to FIGS. 6, 12, and 13, it is seen that the rotary member 56 comprises a hollow tubular member wherein, for example, the inner periphery thereof is internally threaded throughout the entire longitudinal or axial extent thereof as at 64. A through-bore 66 is defined within the central region of the rotary member 56 so as to permit a central portion of the shaft portion 62 of the handle 54 to pass therethrough, and a pair of externally threaded set screws 68, 68, as can be best appreciated from FIGS. 16 and 17, are adapted to be threadedly engaged within the oppositely disposed ends of the internally threaded rotary member 56 so as to engage the shaft portion 62 of the handle 54, when the shaft portion 62 of the handle 54 has been inserted through the through-bore 66, and thereby fixedly secure the shaft portion 62 of the handle 54 at a particular position within the rotary member 56 for a purpose to be discussed more fully hereinafter. As can best be additionally seen and appreciated from FIGS. 16 and 17, the rear end portion of each set screw 68 has a hexagonally configured recess 70 formed therewithin so as to permit a suitable rotary driving tool, such as, for example, an Allen wrench, to be drivingly engaged with the set screw 68 in order to threadedly mount the same within one end portion of the internally threaded bore 64 of the rotary member 56. In addition, the forward end portion of each set screw 68 is provided with a cup-shaped recess 72 such that the forwardmost point of each set screw 68 defines a linear locus having a circular or annular configuration as opposed to a solid circular surface or face. This structure enables each set screw 68 to more effectively grip one of the planar surfaces comprising the hexagonally configured shaft portion 62 of the handle 54 when the set screw 68 is in fact engaged with the shaft portion 62 of the handle 54

Figure 18:
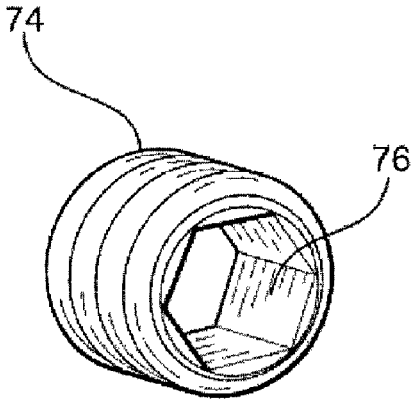
FIG. 18 is a perspective view of a jam-nut member which may be utilized in conjunction with any one of the set screw members as disclosed within FIGS. 16 and 17.
Figure 19:
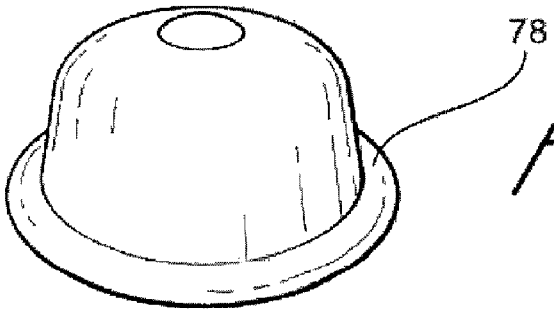
FIG. 19 is a perspective view of a plug member which may be utilized within either one of the rotary tubular member or the secondary cam member as illustrated within FIGS. 12 and 13, or FIGS. 14 and 15, respectively.

Still further, in order to fixedly secure each one of the set screws 68 at its engaged position with the shaft portion 62 of the handle 54, an externally threaded jam nut or jam set screw 74, as illustrated within FIG. 18, may likewise be threadedly engaged within each one of the oppositely disposed end portions of the internally threaded bore 64 of the rotary member 56 until each one of the jam nuts or jam set screws 74, 74 tightly engages a respective one of the set screws 68, 68. In a manner similar to that of each one of the set screws 68, each one of the jam nuts or jam set screws 74, 74 has a hexagonally configured through-bore 76 defined therethrough so as to permit a suitable rotary driving tool, such as, for example, an Allen wrench, to be drivingly engaged with the jam nut or jam set screw 74 in order to respectively threadedly mount the same within one end portion of the internally threaded bore 64 of the rotary member 56. With reference also being made to FIGS. 1-5 and 19, it is additionally seen that end plugs 78, 78, fabricated, for example, from a suitable thermoplastic material, may be respectively inserted, in accordance with a friction or snap-fitting mode of operation, into each open end of the internally threaded bore 64 of the rotary member 56 so as to simply provide the opposite ends of the rotary member 56 with a finished appearance as well as to prevent dirt, debris, contaminants, or the like, from entering such open ends of the internally threaded bore 64.

With reference again being made to FIGS. 1-6, 8, and 12, in order to respectively rotatably secure the oppositely disposed end portions of the rotary member 56 of the handle assembly within the second end portions 42, 42 of the lever members 34, 34, and concomitantly or conversely, in order to respectively positionally secure the second end portions 42, 42 of the lever members 34, 34 onto the oppositely disposed end portions of the rotary member 56, it is seen, as can best be appreciated from FIG. 12, that the external peripheral surface regions of each one of the oppositely disposed end portions of the rotary member 56 are provided with a pair of longitudinally or axially spaced annular recesses or grooves 80, 82 with a non-recessed or non-grooved region 84 defined therebetween. Accordingly, when, for example, the second end portions 42, 42 of the lever members 34, 34 are to be respectively mounted onto the oppositely disposed end portions of the rotary member 56, a first retaining ring, snap-ring, or spring clip 44, similar to the retaining ring, snap-ring, or spring clip 44 illustrated within FIG. 11 and previously described in connection with the respective connecting together or securing of the first end portions 38 of the lever members 34, 34 upon the oppositely disposed end portions 28, 28 of the force transmission cam plate member 26, as illustrated, for example, within FIG. 7, is initially mounted within each one of the axially inner annular grooves or recesses 80, 80. The outwardly projecting oppositely disposed end portions of the rotary member 56 are then respectively inserted through the through-bores 40, 40 defined within the second end portions 42, 42 of the lever members 34, 34 such that the inner peripheral surface regions of the through-bores 40, 40 will respectively effectively be seated upon the external peripheral, non-recessed or non-grooved regions 84, 84 of the oppositely disposed end portions of the rotary member 56. Lastly, a second retaining ring, snap-ring, or spring clip 44, likewise similar to the retaining ring, snap-ring, or spring clip 44 illustrated within FIG. 11, is mounted within each one of the axially outer annular grooves or recesses 82, 82 thereby effectively positionally trapping each one of the second end portions 42, 42 of the lever members 34, 34 upon the oppositely disposed end portions of the rotary member 56. These assemblies are illustrated within, for example, FIGS. 1-4 and 6.

Figure 14:
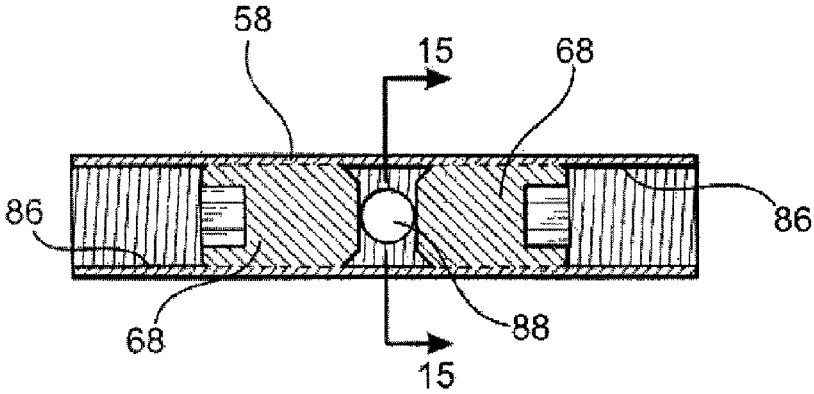
FIG. 14 is a longitudinal cross-sectional view of the secondary cam member of the dual-position connection force level determination mechanism of the new and improved aircraft power connector of the present invention.
Figure 15:
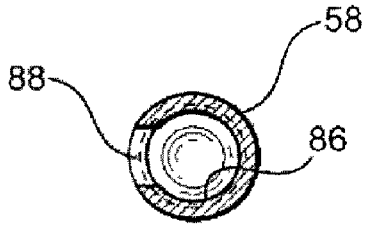
FIG. 15 is a cross-sectional view of the secondary cam member as disclosed within FIG. 14 as taken along the lines 15-15 of FIG. 14.

Continuing further with the description of the structure of the secondary cam member 58, and the mounting of the same onto the distal end portion of the handle 54, and with reference being particularly made to FIGS. 14 and 15, it is seen that the secondary cam member 58 is structurally similar to the rotary member 56 in that the secondary cam member 58 likewise comprises a hollow tubular member wherein, for example, the inner periphery thereof is internally threaded throughout the entire longitudinal or axial extent thereof as at 86, however, in lieu of the through-bore 66 as defined within the central region of the rotary member 56, a blind bore 88 is formed within one centrally located side wall portion of the secondary cam member 58 so as to permit the distal end portion of the shaft portion 62 of the handle 54 to be inserted into the blind bore 88 and effectively be seated upon the oppositely disposed internal side wall portion of the secondary cam member 58. Subsequently, in order to fixedly secure the distal end portion of the shaft portion 62 of the handle 54 within the secondary cam member 58, a pair of externally threaded set screws 68, 68, similar to the set screw 68 previously described and illustrated within FIGS. 16 and 17, are adapted to be threadedly engaged within the oppositely disposed ends of the internally threaded secondary cam member 58.

Still further, as was the case with the structural assembly comprising the rotary member 56, in order to fixedly secure each one of the set screws 68 at its engaged position with the distal end portion of the shaft portion 62 of the handle 54, an externally threaded jam nut or jam set screw 74, similar to that illustrated within FIG. 18, may likewise be threadedly engaged within each one of the oppositely disposed end portions of the internally threaded bore 86 of the secondary cam member 58 until each one of the jam nuts or jam set screws 74, 74 tightly engages a respective one of the set screws 68, 68. Still yet further, as was also the case with rotary member 56, end plugs, similar to the end plugs 78, 78, as illustrated within FIG. 19, may be respectively inserted into each open end of the internally threaded bore 86 of the secondary cam member 58 so as to simply provide the opposite ends of the secondary cam member 58 with a finished appearance as well as to prevent dirt, debris, contaminants, or the like, from entering such open ends of the internally threaded bore 86.

Having described the various structural components comprising the new and improved aircraft power connector 10 of the present invention, the mode of operation of using the new and improved aircraft power connector 10 of the present invention, in order to achieve the relatively low insertion or engagement force and relatively high retention force levels characteristic of the aircraft power connector 10 of the present invention, will now be described. More particularly, when the actuating handle assembly is disposed at the position illustrated within any one of FIGS. 1-3 whereby handle 54 has effectively been rotated in the clockwise direction, around the rotary axis defined by means of the rotary member 56, so as to be disposed at its UNLOCKED position such that the secondary cam member 58 is disengaged from, or disposed out of contact with, the aircraft power connector housing 12, the female receptacle portions of the electrical connector contact pins disposed within the aircraft power connector housing 12 will exhibit a relatively low insertion or engagement force level on the order of, for example, 20 lb±5 lb with respect to the male electrical connector contact pins 20 mounted upon the onboard aircraft electrical connector 16 due to the aforenoted enlarged machining of the female receptacle portions of the electrical connector contact pins disposed within the aircraft power connector housing 12 with respect to the male electrical connector contact pins 20 located upon the onboard aircraft electrical connector 16. Accordingly, at this point in time, the aircraft power connector 10 can be moved by operator personnel from its disengaged position with respect to the onboard electrical connector 16, as illustrated within FIGS. 1 and 2, to its position illustrated within FIG. 3 at which the aircraft power connector 10 is able to be readily and easily physically mated or engaged with, and electrically connected to, the onboard aircraft electrical connector 16 in a coaxially aligned manner.

Subsequently, when it is desired to increase the force level defined between the female receptacle portions of the electrical connector contact pins disposed within the aircraft power connector housing 12 and the male electrical connector contact pins 20 mounted upon the onboard aircraft electrical connector 16 in order to achieve a relatively high retention force level therebetween, the handle 54 is rotated in the counterclockwise direction around the rotary axis defined by means of the rotary member 56 such that the secondary cam member 58 is initially moved from its disposition illustrated within, for example, FIG. 3 to an intermediate position, as illustrated within FIG. 4, wherein the secondary cam member 58 is now disposed in contact with the upper surface portion of the aircraft power connector housing 12. Subsequently, still further, continued rotation of the handle 54 in the counterclockwise direction from its intermediate position, as illustrated within FIG. 4, to its final or LOCKED position, as illustrated within FIG. 5, causes the pair of lever members 34, 34 to undergo rotational or pivotal movement in the counterclockwise direction wherein the pair of lever members 34, 34 will, in turn, cause the force transmission cam plate member 26 to rotate or pivot around its longitudinal axis as a result of the first end portions 38, 38 of the lever members 34, 34 being fixedly connected to the oppositely disposed end portions 28, 28 of the force transmission cam plate member 26.

Recalling the fact that the force transmission cam plate member 26 is disposed within the slot 24 which has been formed between the upper and lower rows of electrical connector bores 22 defined within the forward end portion of the aircraft power connector housing 12, and within which the female receptacle portions of the electrical connector contact pins of the aircraft power connector 10 are disposed, the aforenoted rotational or pivotal movement of the force transmission cam plate member 26 will effectively cause the lower half of the forward end portion of the aircraft power connector housing 12, and the female receptacle portions of the electrical connector contact pins disposed within such lower half of the forward end portion of the aircraft power connector housing 12, to move downwardly a predetermined amount, not only with respect to the upper half of the forward end portion of the aircraft power connector housing 12, but in addition, with respect to the lower row of male electrical connector contact pins 20 mounted upon the onboard aircraft electrical connector 16. As may therefore well be appreciated, this predetermined downward movement of the lower row of female receptacle portions of the electrical connector contact pins, disposed within the aircraft power connector 10, with respect to the lower row of male electrical connector contact pins 20 mounted upon the onboard aircraft electrical connector 16, effectively causes a predetermined amount of coaxial misalignment to be developed between the lower row of female receptacle portions of the electrical connector contact pins, disposed within the aircraft power connector housing 12, and the lower row of male electrical connector contact pins 20 mounted upon the onboard aircraft electrical connector 16. Accordingly, such a predetermined amount of coaxial misalignment developed between the lower row of female receptacle portions of the electrical connector contact pins, disposed within the aircraft power connector housing 12, and the lower row of male electrical connector contact pins 20 mounted upon the onboard aircraft electrical connector 16, results in enhanced or increased surface-to-surface and frictional contact to be developed between the lower row of female receptacle portions of the electrical connector contact pins, disposed within the aircraft power connector housing 12, and the lower row of male electrical connector contact pins 20 mounted upon the onboard aircraft electrical connector 16.

In turn, such enhanced or increased surface-to-surface and frictional contact, developed between the lower row of female receptacle portions of the electrical connector contact pins, disposed within the aircraft power connector housing 12, and the lower row of male electrical connector contact pins 20 mounted upon the onboard aircraft electrical connector 16, results in enhanced or increased retention engagement forces to be developed between the lower row of female receptacle portions of the electrical connector contact pins, disposed within the aircraft power connector housing 12, and the lower row of male electrical connector contact pins 20 mounted upon the onboard aircraft electrical connector 16. Accordingly, the disengagement resistance forces between the lower row of female receptacle portions of the electrical connector contact pins, disposed within the aircraft power connector housing 12, and the lower row of male electrical connector contact pins 20 mounted upon the onboard aircraft electrical connector 16, will likewise be enhanced.

Figure 5:
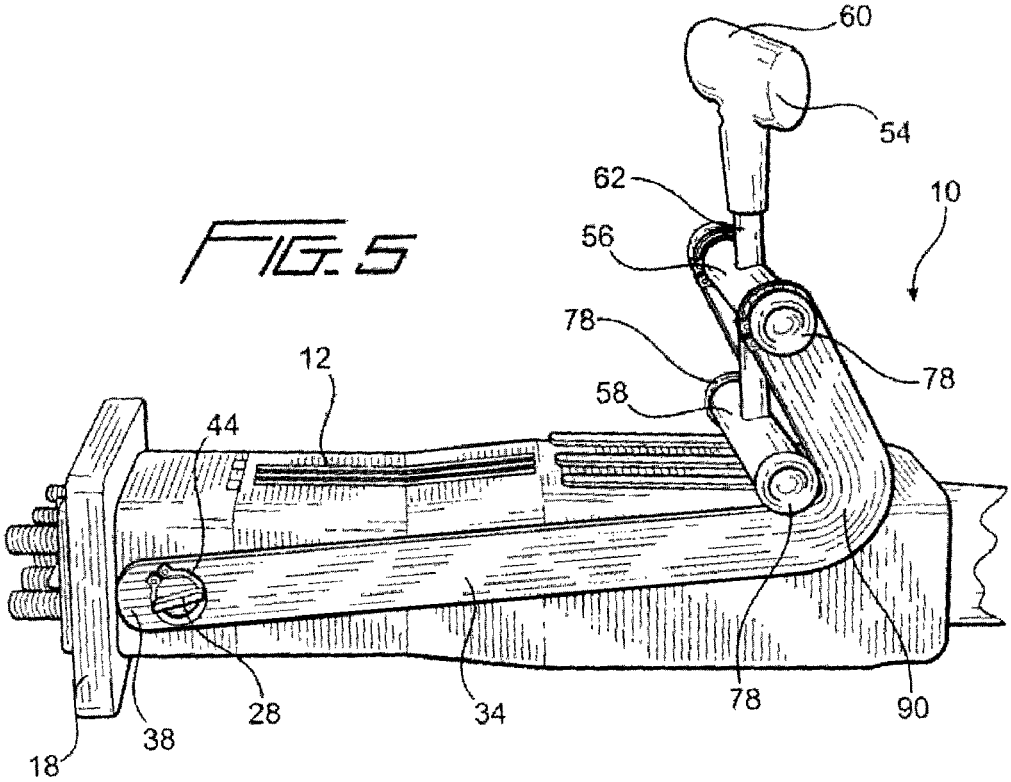
FIG. 5 is a substantially side elevational view of the new and improved aircraft power connector, as illustrated within FIG. 3, wherein, however, the secondary cam member of the dual-position connection force level determination mechanism of the new and improved aircraft power connector is illustrated as being disposed at its fully LOCKED position whereby the new and improved aircraft power connector will exhibit a relatively high retention force level.

It is to be further noted that the actuating handle assembly, comprising the handle 54, the rotary member 56, and the secondary cam member 58, effectively comprises an over-center locking mechanism whereby when the handle 54 is rotated in the counterclockwise direction to its fully LOCKED position, as illustrated within FIG. 5, the secondary cam member 58 will be moved slightly beyond the vertical plane within which the rotary axis, defined by means of the rotary member 56, is located so as to effectively snap into its LOCKED position which is located at the juncture 90 that is defined between the long and short leg portions of each one of the substantially L-shaped lever members 34, 34. It is noted still yet further that the disposition of the handle 54 with respect to the rotary member 56 can be readily adjusted by effectively altering the particular axial location, as taken along the shaft portion 62 of the handle 54, that is locked in position as a result of the engagement of the shaft portion 62 of the handle 54 by means of the set screws 68, 68 disposed within the rotary member 56. Altering the disposition of the handle 54 with respect to the rotary member 56 of course alters the distance or moment arm defined between the secondary cam member 58 and the rotary member 56 so as to, in turn, alter the position at which the secondary cam member 58 will in effect encounter the upper surface portion of the aircraft power connector housing 12. Such an altered state or position will in turn alter the degree to which the lever members 34, 34, and the attached force transmission cam plate member 26, are rotated or pivoted before the secondary cam member 58 attains its final or LOCKED position within the juncture portions 90, 90 of the lever members 34, 34. Accordingly, the degree to which the lower row of female receptacle portions of the electrical connector contact pins, disposed within the aircraft power connector housing 12, and the lower row of male electrical connector contact pins 20 mounted upon the onboard aircraft electrical connector 16, are disposed in frictional contact with respect to each other, which defines the retention force or disengagement resistance force level between the aircraft electrical connector 16 and the aircraft power connector housing 12, can be predeterminedly adjusted.

Figure 3:
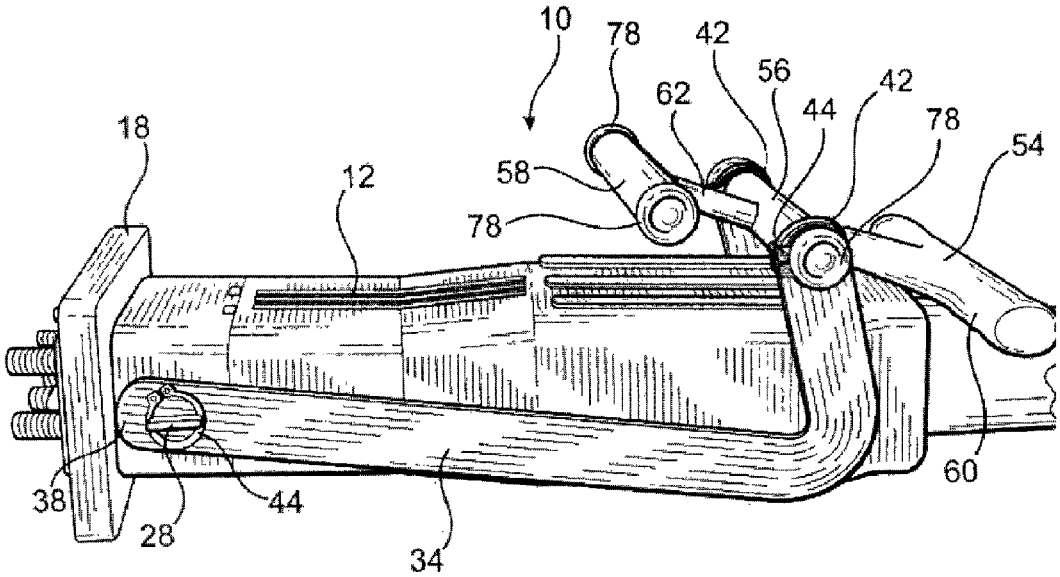
FIG. 3 is a substantially side elevational view of the new and improved aircraft power connector, as illustrated within FIGS. 1 and 2, wherein, however, the new and improved aircraft power connector is illustrated as being electrically connected to the conventional onboard aircraft electrical connector.
Figure 4:
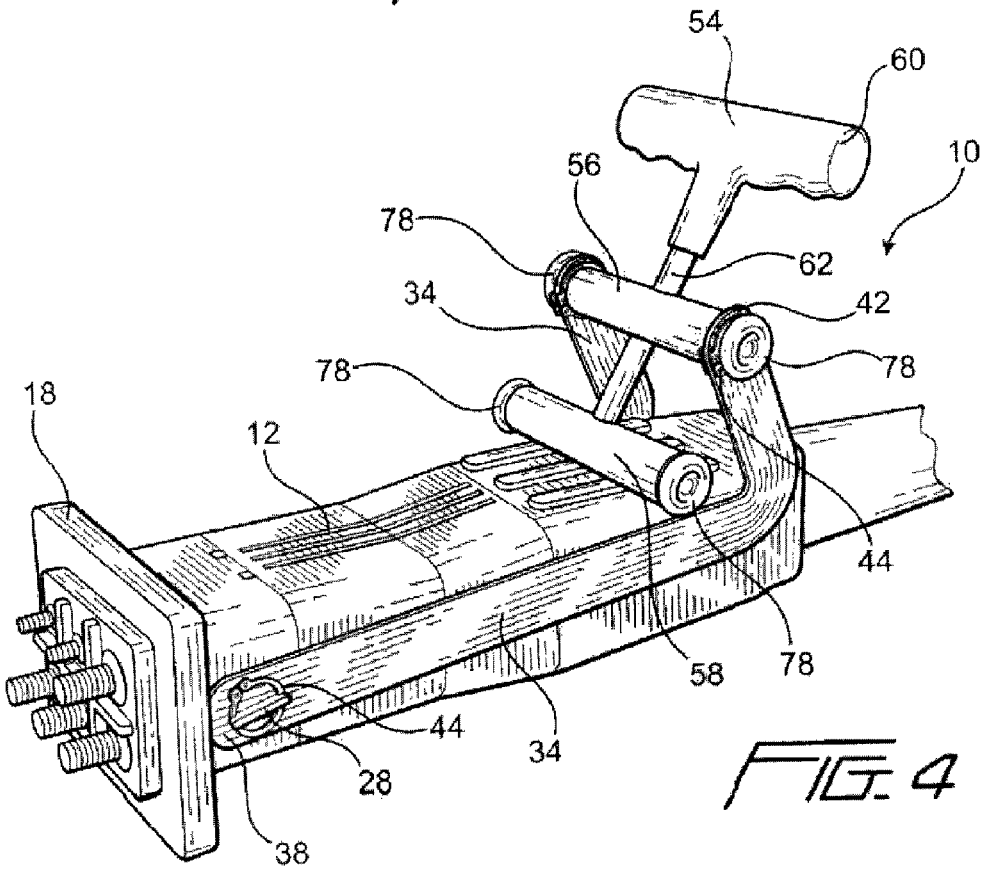
FIG. 4 is a perspective view of the new and improved aircraft power connector as illustrated within FIG. 2, wherein, however, the secondary cam member of the dual-position connection force level determination mechanism of the new and improved aircraft power connector is illustrated as being disposed at an engaged position with respect to an external portion of the aircraft power connector housing.

Lastly, it is of course to be appreciated that when the aircraft power connector 10 is to be intentionally disconnected from the aircraft electrical connector 16, such as, for example, when servicing of the aircraft has been terminated, the handle 54 is rotated in the reverse, clockwise direction from its position illustrated within FIG. 5 toward its position illustrated, for example, within FIG. 3, thus effectively freeing or releasing the secondary cam member 58 from its LOCKED position within the juncture portions 90, 90 of the lever members 34, 34, as illustrated within FIG. 5, and moving the same to its RELEASED position as illustrated, for example, within FIG. 3. This permits the lever members 34, 34, and the operatively connected force transmission cam plate member 26, to be rotatably or pivotally moved in the clockwise direction so as to effectively relieve or reduce the force level, defined between the lower row of female receptacle portions of the electrical connector contact pins, disposed within the aircraft power connector housing 12, and the lower row of male electrical connector contact pins 20 mounted upon the onboard aircraft electrical connector 16, back to its normal predetermined level of 20 lb±5 lb. The aircraft power connector 10 may then be easily and readily disconnected from the aircraft electrical connector 16.

Thus, it may be seen that in accordance with the principles and teachings of the present invention, there has been disclosed a new and improved aircraft power connector, adapted for electrical connection to an aircraft electrical connector, which has incorporated thereon a dual-position mechanism which can effectively alter the engagement force level defined between the electrical connector contact pins of the aircraft power connector and the aircraft electrical connector. When the dual-position mechanism is disposed at a first one of its two positions, the force level defined between the electrical connector contact pins of the aircraft power connector and the aircraft electrical connector is relatively low so as to easily and readily permit connection and disconnection of the aircraft power connector to and from the aircraft electrical connector, whereas when the dual-position mechanism is disposed at a second one of its two positions, the force level defined between the electrical connector contact pins of the aircraft power connector and the aircraft electrical connector is relatively high so as to ensure the connection of the aircraft power connector to the aircraft electrical connector and to prevent the inadvertent disconnection of the aircraft power connector from the aircraft electrical connector.

Obviously, many variations and modifications of the present invention are possible in light of the above teachings. For example, while the slot 24 has been formed within the aircraft power connector housing 12 in order to permit the insertion of the force transmission cam plate member 26 therewithin, the force transmission cam plate member 26 may effectively be encapsulated within the aircraft power connector housing 12 when the same is molded from its suitable, rubber-type material. Accordingly, despite the fact that the force transmission cam plate member 26 is encapsulated within the molded aircraft power connector housing 12, the inherent resilience, characteristic of the rubber-type material, permits the force transmission cam plate member 26 to undergo sufficient movement in order to enhance the force level to be developed between the electrical connector contact pins of the aircraft power connector and the aircraft electrical connector. It is therefore to be understood that within the scope of the appended claims, the present invention may be practiced otherwise than as specifically described herein.

The invention claimed is:

1. An electrical connector for electrical connection with another electrical connector, comprising:

an electrical connector housing;

a plurality of electrical connector pins disposed within said electrical connector housing for establishing electrical connections with corresponding electrical connector pins located upon an other electrical connector;

means defined upon said plurality of electrical connector pins for permitting said plurality of electrical connector pins to establish a first predetermined engagement force level with respect to the corresponding electrical connector pins, such that said plurality of electrical connector pins can be easily engaged with the corresponding electrical connector pins when an electrical connection between said plurality of electrical connector pins and the corresponding electrical connector pins is to be established; and means disposed upon said electrical connector housing for operatively engaging said plurality of electrical connector pins, once said plurality of electrical connector pins have been engaged with the corresponding electrical connector pins, and for establishing a second predetermined engagement force level with respect to the corresponding electrical connector pins, wherein said second predetermined engagement force level is greater than said first predetermined engagement force level, such that said plurality of electrical connector pins cannot be easily disengaged from the corresponding electrical connector pins whereby the electrical connection, defined between said electrical connector pins, and the corresponding electrical connector pins located upon the other electrical connector, will assuredly be retained, wherein said means for operatively engaging the plurality of electrical connector pins comprises:

a cam member disposed within said electrical connector housing for operatively acting upon said plurality of electrical connector pins; and lever means operatively connected to said cam member and movably mounted upon said electrical connector housing between first and second positions such that when said lever means is disposed at said first position, said cam member is disposed at a first position at which said cam member permits said plurality of electrical connector pins to be disposed at first coaxially aligned positions with respect to the corresponding electrical connector pins so as to establish said first predetermined engagement force level between said plurality of electrical connector pins and the corresponding electrical connector pins, whereas when said lever means is disposed at said second position, said cam member is disposed at a second position at which said cam member causes said plurality of electrical connector pins to be disposed at second coaxially misaligned positions with respect to the corresponding electrical connector pins so as to establish a second predetermined engagement force level between said plurality of electrical connector pins and the corresponding electrical connector pins, wherein said second predetermined engagement force level is greater than said first predetermined engagement force level.

2. The electrical connector as set forth in claim 1, wherein:

said means for permitting said plurality of electrical connector pins to establish said first predetermined engagement force level with respect to the corresponding electrical connector pins comprises said plurality of electrical connector pins having diametrical extents that are sufficiently different from the diametrical extents of the corresponding electrical connector pins such that said first predetermined engagement force level, established between said plurality of electrical connector pins and the corresponding electrical connector pins, is relatively low.

3. The electrical connector as set forth in claim 1, wherein said lever means comprises:

a pair of lever members pivotally mounted upon opposite sides of said cam member; and handle means rotatably mounted upon said pair of lever members between a first UNLOCKED position at which said pair of lever members will be disposed at their first positions so as to permit said cam member to be disposed at its first position whereby said plurality of electrical connector pins will be disposed at said first coaxially aligned positions with respect to the corresponding electrical connector pins in order to establish said first predetermined engagement force level and a second LOCKED position at which said pair of lever members will be disposed at their second positions so as to permit said cam member to be disposed at its second position whereby said plurality of electrical connector pins will be disposed at said second coaxially misaligned positions with respect to the corresponding electrical connector pins in order to establish said second predetermined engagement force level.

4. The electrical connector as set forth in claim 3, wherein said handle means further comprises:

a secondary cam member for movement with said handle means between a first position at which said secondary cam member is disposed out of contact with said electrical connector housing, a second intermediate position at which said secondary cam member is disposed in contact with said electrical connector housing so as to cause said pair of lever members to move from said first positions to said second positions, and a third position at which said secondary cam member is engaged with said pair of lever members at a LOCKED position.

5. The electrical connector as set forth in claim 4, wherein said handle means further comprises:

a rotary member defining a rotary axis around which said handle means and said secondary cam member are rotatably mounted; and said secondary cam member, together with said rotary member, define an over-center locking mechanism.

6. The electrical connector as set forth in claim 1, wherein:

said plurality of electrical connector pins are disposed within a pair of rows within said electrical connector housing;

slot means is defined within said electrical connector housing, so as to be interposed between said pair of rows of said plurality of electrical connector pins for dividing said electrical connector housing into two housing sections, each one of said two housing sections containing a predetermined number of said plurality of electrical connector pins; and said cam member is disposed within said slot means so as to cause a first one of said two housing sections to be moved with respect to a second one of said two housing sections, when said lever means moves said cam member from said first position to said second position, so as to permit said predetermined number of said plurality of electrical connector pins, disposed within said first one of said two housing sections, to be moved from said first positions to said second positions with respect to the corresponding electrical connector pins disposed within the other electrical connector.

7. The electrical connector as set forth in claim 1, wherein:

said electrical connector comprises an aircraft power connector for electrical connection to the other electrical connector to be located on board an aircraft.

8. An electrical connection system, comprising:

a first electrical connector comprising a plurality of first electrical connector pins mounted thereon;

a second electrical connector comprising an electrical connector housing;

a plurality of second electrical connector pins disposed within said electrical connector housing for establishing electrical connections with said plurality of first electrical connector pins located upon said first electrical connector;

means defined upon said plurality of second electrical connector pins and said plurality of first electrical connector pins for permitting said plurality of second electrical connector pins to establish a first predetermined engagement force level, with respect to said plurality of first electrical connector pins, such that said plurality of second electrical connector pins can be easily engaged with said plurality of first electrical connector pins when an electrical connection between said plurality of second electrical connector pins and said plurality of first electrical connector pins is to be established; and means disposed upon said electrical connector housing for operatively engaging said plurality of second electrical connector pins once said plurality of second electrical connector pins have been engaged with said plurality of first electrical connector pins and for establishing a second predetermined engagement force level with respect to said plurality of first electrical connector pins, wherein said second predetermined engagement force level is greater than said first predetermined engagement force level, such that said plurality of second electrical connector pins cannot be easily disengaged from said plurality of first electrical connector pins whereby the electrical connection, defined between said plurality of second electrical connector pins and said plurality of first electrical connector pins will assuredly be retained, wherein said means for operatively engaging said plurality of second electrical connector pins comprises:

a cam member disposed within said electrical connector housing for operatively acting upon said plurality of second electrical connector pins; and lever means operatively connected to said cam member and movably mounted upon said electrical connector housing between first and second positions such that when said lever means is disposed at said first position, said cam member is disposed at a first position at which said cam member permits said plurality of second electrical connector pins to be disposed at first coaxially aligned positions with respect to said plurality of first electrical connector pins so as to establish said first predetermined engagement force level, whereas when said lever means is disposed at said second position, said cam member is disposed at a second position at which said cam member causes said plurality of second electrical connector pins to be disposed at said second coaxially misaligned positions with respect to said plurality of first electrical connector pins located upon said first electrical connector so as to establish said second predetermined engagement force level.

9. The electrical connection system as set forth in claim 8, wherein:

said means for permitting said plurality of second electrical connector pins to easily establish said first predetermined engagement force level with respect to said first electrical connector pins comprises said plurality of first electrical connector pins having first predetermined diametrical extents, and said plurality of second electrical connector pins having second diametrical extents that are sufficiently different from said first diametrical extents such that said first predetermined engagement force level, established between said plurality of electrical connector pins and said plurality of first electrical connector pins is relatively low.

10. The electrical connection system as set forth in claim 8, wherein said lever means comprises:

a pair of lever members pivotally mounted upon opposite sides of said cam member disposed within said electrical connector housing; and handle means rotatably mounted upon said pair of lever members between a first UNLOCKED position at which said pair of lever members will be disposed at their first positions so as to permit said cam member to be disposed at its first position whereby said plurality of second electrical connector pins will be disposed at said first coaxially aligned positions, and a second LOCKED position at which said pair of lever members will be disposed at their second positions so as to permit said cam member to be disposed at its second position whereby said plurality of second electrical connector pins will be disposed at said second coaxially misaligned positions.

11. The electrical connection system as set forth in claim 10, wherein said handle means further comprises:

a secondary cam member for movement with said handle means between a first position at which said secondary cam member is disposed out of contact with said electrical connector housing, a second intermediate position at which said secondary cam member is disposed in contact with said electrical connector housing so as to cause said pair of lever members to move from said first positions to said second positions, and a third position at which said secondary cam member is engaged with said pair of lever members at a LOCKED position.

12. The electrical connection system as set forth in claim 11, wherein said handle means further comprises:

a rotary member defining a rotary axis around which said handle means and said secondary cam member are rotatably mounted; and said secondary cam member, together with said rotary member, define an over-center locking mechanism.

13. The electrical connection system as set forth in claim 8, wherein:

said plurality of second electrical connector pins are disposed within a pair of rows within said electrical connector housing;

slot means is defined within said electrical connector housing, so as to be interposed between said pair of rows of said plurality of second electrical connector pins for dividing said electrical connector housing into two housing sections, each one of said two housing sections containing a predetermined number of said plurality of said second electrical connector pins; and said cam member is disposed within said slot means so as to cause a first one of said two housing sections to be moved with respect to a second one of said two housing sections when said lever means moves said cam member from said first position to said second position, so as to permit said predetermined number of said plurality of second electrical connector pins to be moved from said first positions to said second positions.

14. The electrical connection system as set forth in claim 8, wherein:

said first electrical connector comprises an electrical connector located on board an aircraft; and said second electrical connector comprises an aircraft power connector for electrical connection to said first onboard aircraft electrical connector.

15. A system, comprising:

a first electrical connector, comprising:

a first electrical connector housing;

a plurality of first electrical connector pins disposed within the first electrical connector housing, wherein the first electrical connector pins are configured to connect with second electrical connector pins of a second electrical connector;

a cam coupled to the first electrical connector housing, wherein the cam is configured to bias the first electrical connector pins; and a lever coupled to the first electrical connector housing and the cam, wherein the lever is configured to move between first and second lever positions to move the cam between respective first and second cam positions relative to the first electrical connector pins, the first electrical connector pins are configured to generally coaxially align with the second electrical connector pins in the first cam position to provide a first engagement force level between the first and second electrical connector pins, the first electrical connector pins are configured to coaxially misalign with the second electrical connector pins in the second cam position to provide a second engagement force level between the first and second electrical connector pins, and the second engagement force level is greater than the first engagement force level.

16. The system of claim 15, wherein the first electrical connector pins are female pins, the second electrical connector pins are male pins, and the male pins fit inside the female pins.

17. The system of claim 15, wherein the cam is disposed inside the first electrical connector housing, and the lever extends outside of the first electrical connector housing.

18. The system of claim 15, comprising a handle coupled to the lever, wherein the lever comprises a pair of levers disposed about opposite sides of the cam.

19. The system of claim 15, comprising a second cam and a handle coupled to the lever at a pivot joint, wherein the second cam and the handle are disposed on opposite sides of the pivot joint.

20. A system, comprising:

a first electrical connector, comprising:

a first electrical connector housing;

a plurality of first electrical connector pins disposed within the first electrical connector housing, wherein the first electrical connector pins are configured to connect with second electrical connector pins of a second electrical connector;

a cam coupled to the first electrical connector housing; and an actuator coupled to the first electrical connector housing, wherein the actuator is configured to rotate the cam between first and second cam positions relative to the first electrical connector pins, the cam is configured to progressively bias the first electrical connector pins crosswise to axes of the first electrical connector pins during rotation of the cam from the first cam position to the second cam position, the first cam position provides a first engagement force level between the first and second electrical connector pins, the second cam position provides a second engagement force level between the first and second electrical connector pins, and the second engagement force level is greater than the first engagement force level.

21. The system of claim 20, wherein the first electrical connector pins are female pins, the second electrical connector pins are male pins, and the male pins fit inside the female pins.

22. The system of claim 20, wherein the cam is disposed inside the first electrical connector housing, and the actuator comprises a lever extending outside of the first electrical connector housing.

23. The system of claim 22, comprising a handle coupled to the lever, wherein the lever comprises a pair of levers disposed about opposite sides of the cam.

24. The system of claim 20, comprising a second cam and a handle coupled to the actuator at a pivot joint, wherein the second cam and the handle are disposed on opposite sides of the pivot joint.

* * * * *